United States Patent [19]

Corain et al.

[11] Patent Number: 4,884,598

[45] Date of Patent: Dec. 5, 1989

[54] SYSTEM FOR INSTANTANEOUSLY DETECTING BREAKAGE OF A WEFT YARN IN A MULTIPHASE LOOM SHED

[75] Inventors: Luciano Corain; Gianni Maitan, both of Vicenza; Enrico Valsecchi, Valdagno, all of Italy

[73] Assignee: NUOVOPIGNONE-Industrie Meccaniche e Fonderia, S.p.A., Italy

[21] Appl. No.: 238,255

[22] Filed: Aug. 30, 1988

[30] Foreign Application Priority Data

Nov. 20, 1987 [IT] Italy ..... 22710 A/87

[51] Int. Cl.[4] ..... D03D 51/34

[52] U.S. Cl. ..... 139/371; 139/436

[58] Field of Search ..... 139/436, 370.1, 370.2, 139/371

[56] References Cited

U.S. PATENT DOCUMENTS

| | | | |
|---|---|---|---|
| 3,322,162 | 5/1967 | Rydborn | 139/371 |
| 3,802,469 | 4/1974 | Loepfe | 139/371 |
| 4,031,924 | 6/1977 | Domig et al. | 139/371 |
| 4,763,699 | 8/1988 | Corain et al. | 139/371 |

*Primary Examiner*—Henry S. Jaudon

*Attorney, Agent, or Firm*—Morgan & Finnegan

[57] ABSTRACT

A system for instantaneously detecting breakage of a weft yarn within the shed of a multiphase loom comprising a series of closed-loop induction coils which extend in succession along the entire weaving zone to cooperate with the rotating shuttle weft yarn packages, which are provided with at least one off-centered magnetic element.

3 Claims, 4 Drawing Sheets

SYSTEM FOR INSTANTANEOUSLY DETECTING BREAKAGE OF A WEFT YARN IN A MULTIPHASE LOOM SHED

FIELD OF THE INVENTION

This invention relates to a detection system by which breakage of a weft yarn in a multiphase loom shed can be detected as soon as it occurs, so considerably increasing the capacity of said type of loom and the quality of the fabric produced by it.

DESCRIPTION OF THE PRIOR ART

A multiphase loom is a special known loom in which a series of shuttles in carousel arrangement insert a number of weft yarns into the fabric in rapid succession. Specifically, each shuttle with its package of weft yarn is inserted into a warp yarn shed which opens in front of it and then closes as soon as the shuttle has passed, to immediately reopen, when the warp yarns have crossed, to form a new shed into which the next shuttle is inserted and so on, to give rise to the characteristic wave pattern well known to experts of the art.

In such a type of loom, as the moving warp yarns continuously cross in successive sheds there is no possibility of inserting photoelectric cells or other sensitive elements able to sense breakage of a weft yarn within the shed, as already used in single-phase looms.

In this respect, such a loom currently only comprises one sensor on one side of the loom, this signalling the presence or absence of a weft only when the corresponding shuttle leaves the weaving zone and thus only when a large number of further wefts have been inserted into the fabric, which can thus no longer be repaired.

OBJECT OF THE INVENTION

The object of the present invention is to obviate said drawback by providing a system which enables the breakage of a weft yarn within the weaving zone of a multiphase loom to be detected the instant it occurs, so enabling the loom to be interrupted as soon as a weft yarn breaks or is no longer present, this making simple, immediate and total elimination of the disturbance possible by simply replacing the shuttle with a further loaded one if the weft yarn has run out on the package of the first shuttle, or by using the same shuttle after joining together the cut weft yarn ends. In this manner defective fabric is no longer obtained.

SUMMARY OF THE INVENTION

The problem is substantially solved by detecting not the breakage of a weft yarn and thus its presence or absence in the shed of a multiphase loom, but instead the rotation or non-rotation of the shuttle package. In this respect it is apparent that if the shuttle package rotates, this is a reliable indication that the weft yarn is unwinding correctly from the package and is therefore present in the shed. In contrast, if the weft yarn is broken or has run out and is therefore not present in the shed, the package cannot be rotating.

Said package rotation is detected magnetically, according to the invention, by the presence of a certain level of signal induced in closed-loop induction coils external to the shed by variation in the magnetic field generated by off-centered magnets rigidly fixed to the package and thus rotating with it.

In other words, according to the present invention, the package of each shuttle of the multiphase loom is provided with at least one off-centered magnetic element, there being also provided an overlying series of closed-loop induction coils which are provided in succession over the entire weaving zone and are connected to a device for de-energising or halting the loom.

In this manner three conditions of operation can be distinguished, namely the shuttle not present, the shuttle present but the package not rotating, and the shuttle present with the package rotating.

In this respect, if the shuttle is absent the magnetic elements fixed to it are also absent and there is no magnetic field intersecting the induction coils with the result that no signal is induced in these latter. In the second case as the shuttle moves along the weaving zone the magnetic field generated by the magnetic elements on the non-rotating package enters beneath a induction coil and then leaves to cause some variation in the magnetic flux linked with said induction coil to induce a low-intensity signal in it. Finally, if the package rotates the magnetic field generated by its magnetic elements will be a rotating field and will therefore intersect the overlying induction coil several times to cause a greater variation in the magnetic flux linked with said induction coil and thus induce a higher-intensity signal in it.

Thus, normal operation of the loom, with the weft yarn perfectly inserted, is characterised by the presence of a signal of relatively high intensity across the induction coils, such that when it falls below a certain predetermined threshold (for example corresponding to the signal level produced by a non-rotating package) it is able to cause the device for de-energising or halting the loom to operate and thus ensure that the loom is immediately halted as soon as a weft yarn breakage occurs. It is preferable not to allow two successive shuttles to simultaneously influence one and the same induction coil otherwise interference would occur between the two rotating magnetic fields generated by the magnetic elements of the packages of said shuttles, with consequent superimposing of the signals obtained across the induction coil, and thus the closed-loop induction coils are preferably of length equal to or less than the distance between two successive shuttles.

The invention is described in detail hereinafter with reference to the accompanying drawings which illustrate a preferred embodiment thereof by way of non-limiting example in that technical or constructional modifications can be made thereto but without leaving the scope of the present invention.

For example, induction coils of greater length than the distance between two adjacent shuttles could be used by employing a suitable signal measurement circuit.

DESCRIPTION OF THE PREFERRED EMBODIMENT

The accompanying drawings, referred to herein and constituting a part hereof, illustrate the preferred embodiment of the present invention, and together with the description serve to explain the principles of the invention.

Figure 1:
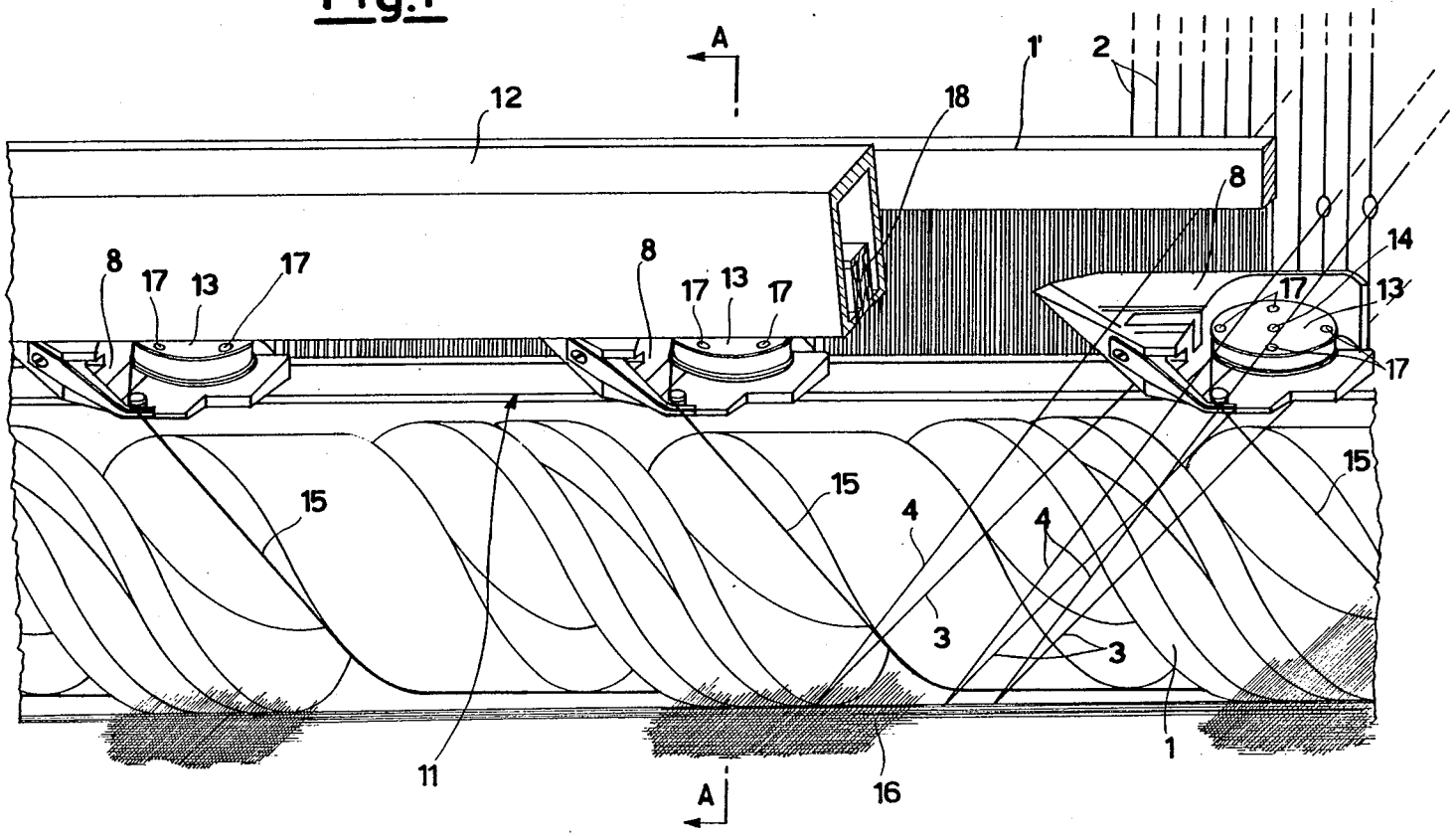
FIG. 1 is a partial perspective view of the weaving zone of a multiphase loom using the detection system according to the invention, the warp yarns forming the various sheds being omitted for clarity.
Figure 2:
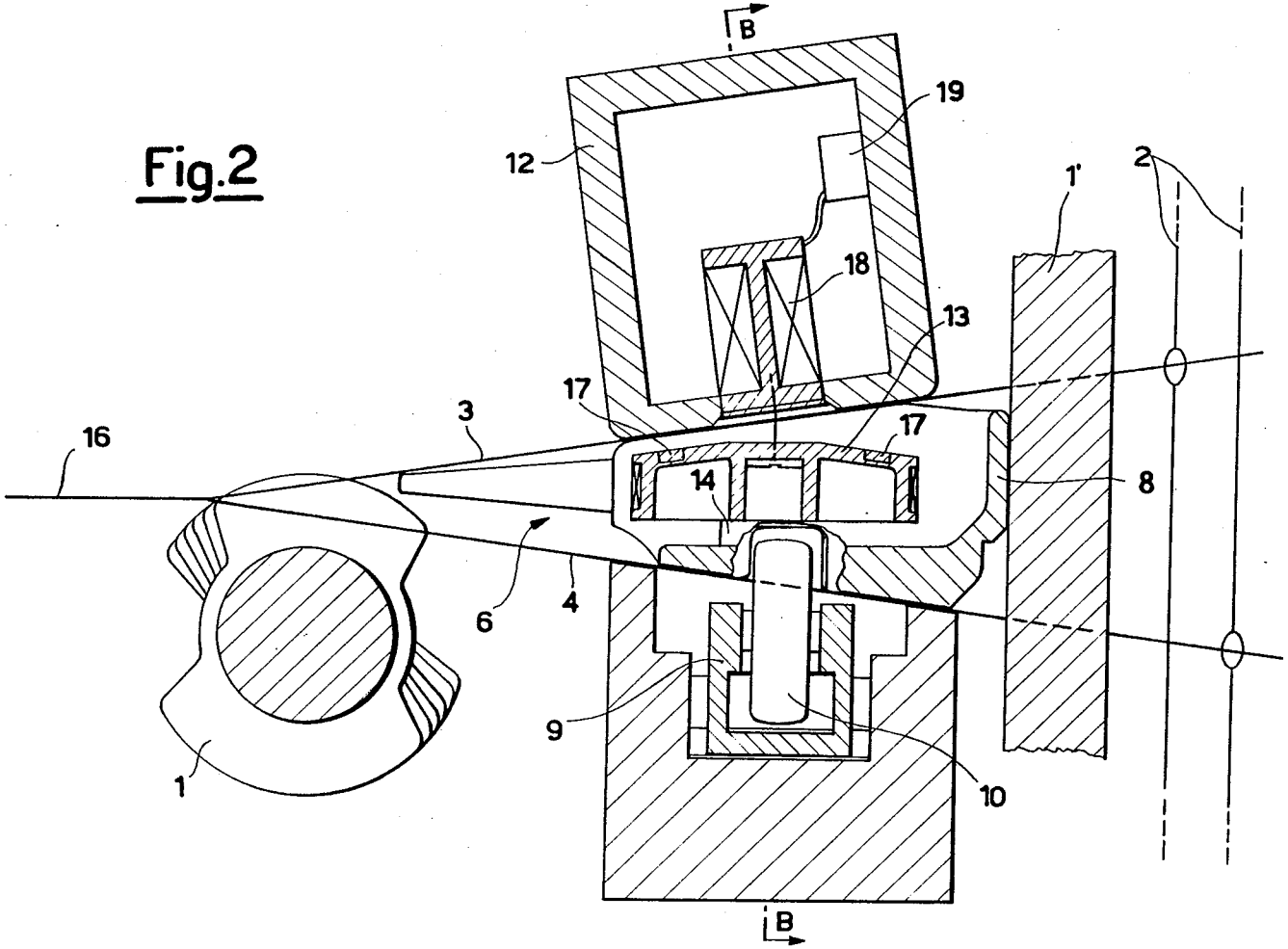
FIG. 2 is a side sectional view to an enlarged scale taken on the line A—A of FIG. 1.
Figure 3:
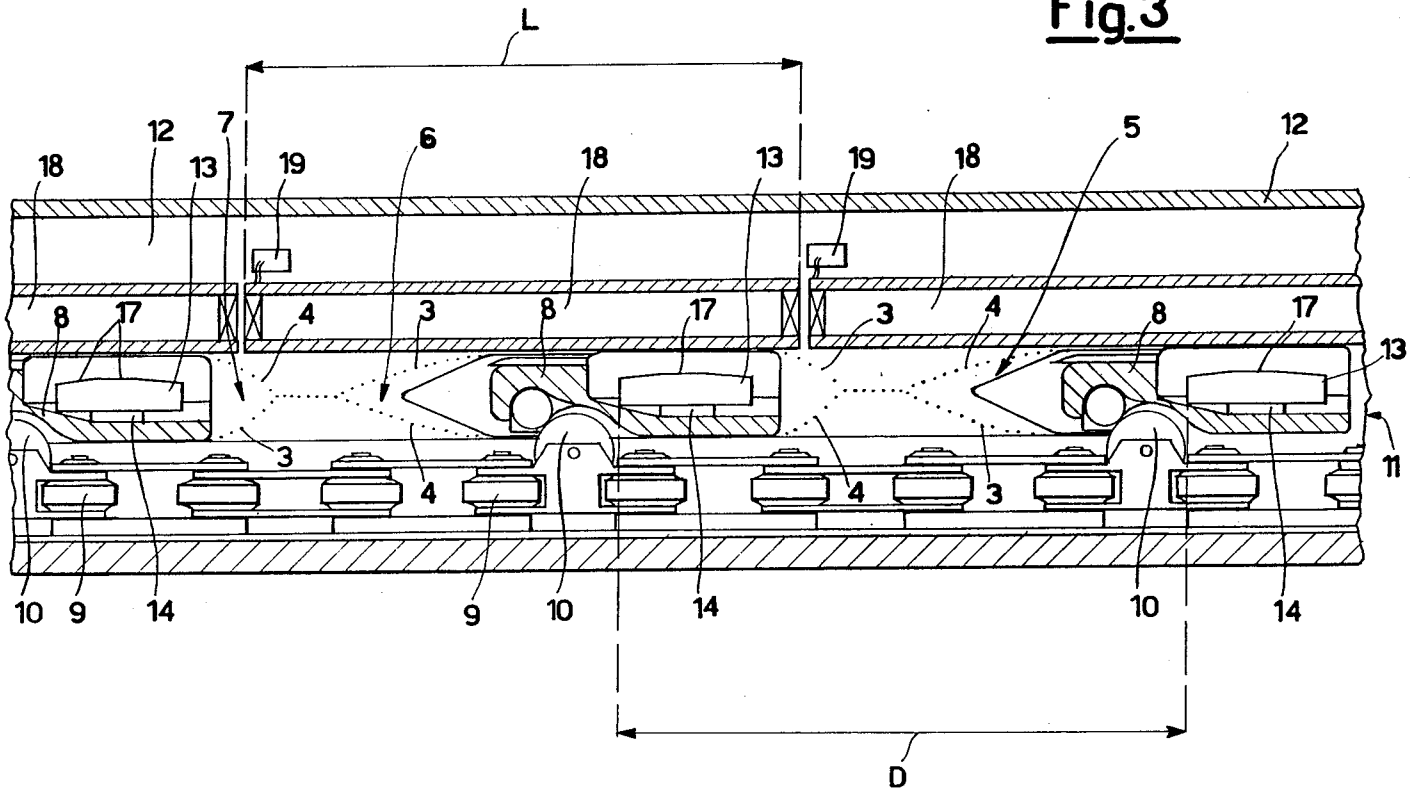
FIG. 3 is a central longitudinal sectional view to an enlarged scale taken on the line B—B of FIG. 2.

In the figures, the reference numeral 1 indicates the rotating reed of the multiphase loom, 1' the fixed reed and 2 the heddles which cause the warp yarns 3 and 4 to cross over and form the successive sheds 5, 6, 7, . . . (see FIG. 3 specifically) into which the equidistant shuttles 8, conveyed in a carousel arrangement by a conveyor chain 9 and drive rollers 10, are inserted.

The shuttles 8 are guided upperly in the weaving zone 11 by a shuttle pusher bar 12 and each contains a yarn package 13 rotatable about its central pin 14 and carrying the weft yarn 15 which is unwound from the package by the effect of the travel of the shuttle along the weaving zone, the package being made to rotate, and is deposited in the shed where it is beaten up by the reed 1 against the edge of the forming fabric 16.

Figure 4:
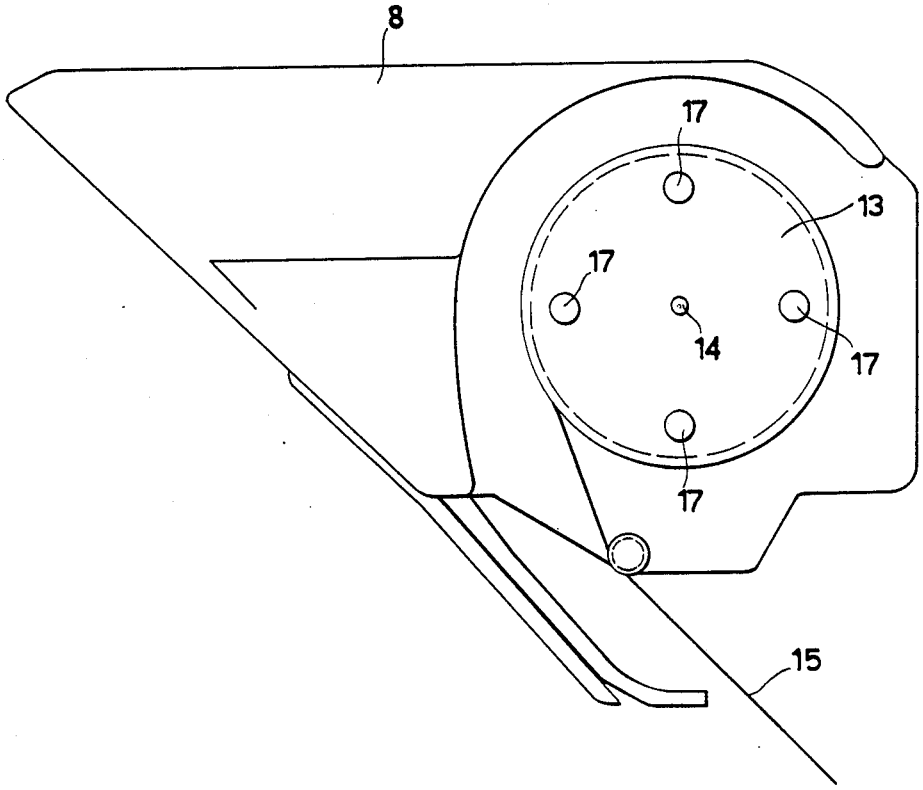
FIG. 4 is a plan view to an enlarged scale of a shuttle used in the detection system according to the invention.

Each shuttle 8 contains a yarn package 13 which, as noted, can rotate about central pin 14. The yarn package 13 contains at least one magnetic element 17 located anywhere on the yarn package 13 except the central pin 14. By so positioning the magnetic element 17 it will describe a circular path about central pin 14 when the yarn package 13 rotates. FIG. 4 shows a yarn package 13 having four magnetic elements 17, which elements 17 are disposed in pairs about central pin 14. The magnetic elements 17 of each pair and central pin 14 lie along lines intersecting at central pin 14; in the preferred embodiment, these lines are perpendicular. As yarn package 13 rotates so will magnetic elements 17; this movement produces a magnetic field which, when measured at a stationary position, fluctuates cyclically. The lateral movement of the yarn package across the loom will also produce a magnetic field, which when similarly measured, varies by first increasing and then decreasing.

Finally, inside shuttle pusher bar 12 and extending in succession along the entire weaving zone 11 there is mounted a series of closed-loop induction coils 18 cooperating with the changing magnetic fields generated by said magnetic elements 17 of the packages 13 of the shuttles 8, the ends of each of said closed-loop induction coils being connected to an electrical device 19 acting on a system for de-energising or halting the multiphase loom, not shown in the figures.

The present invention is capable of ascertaining when the yarn package is rotating and when it is not. Varying magnetic fields induce varying electrical currents in the induction loops 18. As described herein, the present invention thereby senses when yarn package 13 is not rotating, signifying that either the weft yarn 15 supply has run out or that the weft yarn 15 has broken.

When a multiphase loom shuttle 8 operates properly, the weft yarn 15 pays out from yarn package 13 as the shuttle moves across the weaving zone, causing yarn package 13 to rotate about central pin 14. Should the weft yarn 15 break or run out the yarn package 13 ceases rotating.

Each induction coil 18 will therefore sense one of three possible magnetic field conditions. First, the shuttle 8 may be far from the induction coil 18 and so the induction coil 18 will see little or no magnetic field, which in turn will induce little or no electric current in the induction coil 18. Second, the shuttle 8 may pass beneath the induction coil 18 but because either the weft yarn 15 has broken or run out, the yarn package 13 is not rotating. In this case the induction coil 18 will experience a magnetic field which simply increases and then decreases, inducing a fairly low-level current in the induction coil 18. In the third case, the weft yarn 15 smoothly pays out from the rotating yarn package 13 as the shuttle 8 moves across the weaving zone. As the magnetic elements 17 in yarn package 13 spin the magnetic field seen by induction coil 18 will fluctuate rapidly, inducing a likewise rapidly fluctuating high-intensity current in the induction coil 18.

So long as the current induced in the induction coil 18 by the magnetic elements remains at a high level corresponding to the third state wherein the yarn package 13 is rotating, the electrical device 19 for de-energizing or halting the multiphase loom will not be activated. Only after the current falls below a certain value corresponding to that produced when a non-rotating yarn package 13 passes beneath the induction coil 18 will the system stop the loom. The system must be able to discriminate between the two desirable magnetic field conditions, namely the high intensity, fluctuating field and the no-field condition, and the undesirable low-intensity field. The electrical device 19 which halts the loom is not in and of itself novel. Those possessing ordinary skill in the electrical art will recognize that the electrical device 19 is a circuit which senses when a current or voltage falls below some minimum trigger level, and when that happens, activates a mechanism to stop the loom.

According to a preferred embodiment, each induction coil 18 has a longitudinal extension L (see FIG. 3) which is less than or equal to the distance D between the packages 13 of two adjacent shuttles.

We claim:

1. A system for detecting breakage of a weft yarn in a multi-phase loom having at least one shed, a weaving zone, and a plurality of successively disposed shuttles, each said shuttle being able to move across said weaving zone and having a rotatably-mounted yarn package, which yarn package dispenses a weft yarn into said shed, wherein the improvement comprises:

at least one off-center magnetic element mounted on said yarn package so that as said yarn package rotates said magnetic element describes a circular path;

a plurality of closed-loop induction coils extending along said weaving zone, each said induction coil being disposed so that a fluctuating electric current is induced in said coil as said yarn package simultaneously rotates and moves across said weaving zone, and a less intense current which smoothly increases and then decreases is induced when said yarn package moves across said weaving zone without said yarn package rotating;

means for electrically sensing when said yarn package has ceased rotating; and means for halting said loom, said means for sensing triggering said means for halting and stopping said loom when said yarn package passes along said weaving zone without said yarn package rotating.

2. A system for detecting breakage of a weft yarn as in claim 1 wherein each said rotating yarn package has four magnetic elements disposed in two pairs, the members of each pair opposing one another about the axis of rotation, so that each magnetic element lies on a single circle about said axis of rotation, said magnetic elements being separated from the adjacent magnetic elements by 90°.

3. A system for detecting breaking of a weft yarn as in claim 1 wherein each said closed loop induction coils is of a length no greater than the distance between two consecutive yarn packages.

* * * * *